United States Patent [19]

Wissman et al.

[11] 4,376,410

[45] Mar. 15, 1983

[54] PRESS GUIDE STRUCTURE

[75] Inventors: Terry L. Wissman, New Bremen; Daniel A. Schoch, Minster, both of Ohio

[73] Assignee: The Minster Machine Company, Minster, Ohio

[21] Appl. No.: 299,827

[22] Filed: Sep. 8, 1981

[51] Int. Cl.[3] ..... B30B 13/00; B30B 15/04

[52] U.S. Cl. ..... 100/214; 72/455; 100/258 R; 100/282

[58] Field of Search ..... 100/214, 282, 292, 258 R, 100/258 A; 72/455

[56] References Cited

U.S. PATENT DOCUMENTS

| | | | |
|---|---|---|---|
| 2,745,338 | 5/1956 | Wissman | 100/282 |
| 2,890,648 | 6/1959 | Martindell | 100/282 X |
| 3,858,432 | 1/1975 | Voorhees | 72/455 |

*Primary Examiner*—Billy J. Wilhite

*Attorney, Agent, or Firm*—Albert L. Jeffers; John F. Hoffman

[57] ABSTRACT

The present invention relates to a mechanical press, and in particular to a guiding arrangement for the reciprocating slide of such a press. The press comprises a crown and bed and a plurality of vertical uprights connecting the crown and bed. A plurality of guideposts are rigidly connected to the crown and depend downwardly therefrom, the guideposts being parallel to each other and substantially perpendicular to the plane of the bed. The guideposts each have free ends which are unsupported and terminate short of the bed of the press so that the parallelism of the guidepins is determined solely by their connection to the crown. In order to counteract the non-vertical forces exerted on the slide by the connection arms, which tend to cause the slide to tilt about a horizontal axis perpendicular to the axis of the crankshaft, bearings are mounted between the connection assembly and the crown. The bearings exert restraining forces on the connection assembly in a direction perpendicular to the axis of reciprocation of the slide and along lines which intersect the axis of rotation of the wrist pins. In a preferred embodiment of the invention, the bearings are hydrostatic bearings interposed between the connection pistons and their respective cylinders, although hydrodynamic or roller bearings could be used. By this arrangement, the slide and connection arm assembly is accurately guided by elements which are connected only to the crown portion of the press so that the frame of reference for alignment is more localized than in prior art presses wherein tie rods or guideposts are also connected to the bed.

17 Claims, 12 Drawing Figures

PRESS GUIDE STRUCTURE

BACKGROUND OF THE INVENTION

The present invention relates to a mechanical press, and in particular to a guiding arrangement for the reciprocating slide of such a press.

A typical press of the mechanical variety comprises a bed which is mounted to a platform or the floor of the shop, a vertically spaced crown portion in which the drive assembly for the slide is contained, and one or more uprights rigidly connecting the bed and crown and maintaining the bed and crown in vertically spaced relationship. The crown contains the drive assembly, which typically comprises a crankshaft having a plurality of eccentrics thereon and connections connected to the eccentrics of the crankshaft at their upper ends and to the slide at their lower ends. The slide is mounted within the uprights for vertical reciprocating motion and is adapted to have the upper half of the die set mounted to it with the other half mounted to the bolster, which is connected to the bed.

At one end of the crankshaft there is usually mounted a flywheel and clutch assembly wherein the flywheel is connected by a belt to the output pulley of the motor so that when the motor is energized, the massive flywheel rotates continuously. When the clutch is energized, the rotary motion of the flywheel is transmitted to the crankshaft which causes the connections to undergo rotary-oscillatory motion that is transmitted to the slide assembly by means of a wrist pin, for example, so that the rotary-oscillatory motion is converted to straight reciprocating motion. The connections may be connected directly to the slide or connected by means of pistons which are in turn slidably received within cylinders connected to the crown. An example of this latter type of construction is disclosed in U.S. Pat. No. 3,858,432, which is owned by the assignee of the present application.

The slide is usually mounted in the space defined by the crown, bed and uprights and is very accurately guided for rectilinear movement in the vertical direction in the case of a straight sided press, and in a direction slightly inclined rearwardly from vertical in the case of an open back inclined press. The slide must move very accurately along its axis of reciprocation in order to ensure that the two die halves mate properly during stamping or forming of the part. One very commonly used guiding system comprises a plurality of gibs mounted directly to the uprights, the gibs having very accurately machined and oriented guide surfaces that engage the slide as it reciprocates vertically. In this type of guiding system, as in most other guiding systems, the die sets also include guide pins which provide additional guiding of one die half relative to the other in addition to the guiding of the slide which is built into the press itself.

A further type of slide guiding comprises a plurality of guideposts rigidly connected to the crown and bed and extending in the vertical direction. The slide includes bushings or the like that slide over the guideposts and are typically machined with very close tolerances so that there is adequate stiffness to cause the slide to reciprocate in the proper direction. A problem with this type of guiding system, however, is that the guideposts are quite long since they must extend from their points of attachment on the crown and bed, and this length makes it quite difficult to achieve and maintain the parallelism which is necessary between them so that the slide can reciprocate accurately and without binding. Such guideposts are also expensive to manufacture because of their long length and the fact that they must be an accurately machined part. A further prior art type of slide guiding system comprises a plurality of guide bushings rigidly mounted to the bed of the press but terminating short of the crown so that they are supported in a cantilevered fashion. Guideposts are then rigidly connected to the slide and extend downwardly and into the guide bushings. Because the guide bushings are mounted only at one end to the bed yet must extend upwardly a considerable distance in order to meet the guideposts connected to the crown, results in a large cantilevered load at the end of the bushings, and it is quite difficult to maintain the accuracy and stiffness which is necessary at these distances from the point of mounting the bushings to the bed. A still further disadvantage to the cantilevered bushing arrangement is the cost involved, since the bushings must be quite massive and accurately machined along their length.

A problem which has been experienced in the past in connection with mechanical presses is the tendency of the slide to be tilted in the front to back direction about a horizontal axis. Although the slide itself is guided, either by the gib, guidepost or guide bushing arrangements described above, as the crankshaft eccentric rotates beyond its top dead center position, the force exerted by the connections on the slide is no longer completely vertical, but includes a horizontal component of force which increases as the eccentric moves to the 90° past top dead center position. This horizontal component of force tends to cause the slide to tilt about a horizontal axis thereby resulting in nonparallelism between the slide and bolster which can cause improper stamping or forming of the part. Additionally, increased wear on the guide bearing surfaces is likely to occur. In order to overcome this tilting motion, prior art presses having employed bearings that engage the ram or connection itself. A disadvantage to this system wherein the ram or connection is guided by means of bearings in the crown but the slide itself is guided by means of guideposts or bearings which are connected, at least at one end, to the bed portion of the press frame is that there are two spatially separated frames of reference for the guide system, one on the crown and one on the bed. In the aforementioned U.S. Pat. No. 3,858,432, the pistons that connect the connections to the slide are centered within their respective cylinders by means of a plurality of hydrostatic bearings located around the periphery. Although this provides a very good bearing for the connections, the slide itself is not directly guided, and the only other structure contributing to the guiding may be the guide pins associated with the die halves.

SUMMARY OF THE INVENTION

The present invention overcomes the above-discussed disadvantages and problems with prior art slide guiding systems by providing the anchoring points for the guideposts and for the bearings associated with the connections directly on the crown itself rather than by also utilizing the bed as a frame of reference. The slide is guided on a plurality of guideposts, such as four posts in the preferred embodiment, which are connected at their proximal ends to the crown and have distal ends which are unsupported and terminate short of the bed. The slide comprises a corresponding number of guide bushings which slide over the guideposts and are very accurately guided thereby. Because the slide is located in close proximity to the crown, this enables the guideposts to be relatively short thereby avoiding the aforementioned problems of large cantilevered loads, which occur when guide bushings mounted on the bed are utilized. Furthermore, the guideposts rely only on their connection to the crown to maintain parallelism and do not have to extend the long distance between the crown and bed in order to anchor the other ends.

In order to counteract the forces causing the slide to tilt from front to rear about a horizontal axis, bearings are provided between the connection arm assembly of the crown so that forces are exerted on the connection assembly in a horizontal plane perpendicular to the axis of rotation of the crankshaft. In the preferred embodiment, these bearings are hydrostatic bearings wherein two pockets are provided for each piston spaced 180° opposite each other through the piston. In order to apply the counteracting forces at the most effective point on the connection arm assembly, the bearings are located along a line which is intersected by the axis of the wrist pin as it reciprocates.

The preferred embodiment of the press includes a dynamic balancing system comprising a weight which is driven by the crankshaft through a counterbalance connection arm such that the weight moves in the opposite direction as the connection arms and slide on each revolution of the press. Rather than guiding the counterweight by means of a gib arrangement as has been used previously, a pair of guide pins rigidly connected to the crown and extending upwardly are received within bushings to the counterweight. This is advantageous in that the guiding system is relatively simple and the entire drive assembly including the counterweight can be inserted into the crown of the press as a modular unit. The weight can be inserted over the guide pins or, alternatively, the guide pins can be inserted through the crown and into the weight after the drive assembly is installed.

Specifically, the present invention comprises a mechanical press having a bed, a crown, a frame interconnecting the bed and crown, a crankshaft rotatably mounted in the crown, and at least one connection arm connected to an eccentric portion of the crankshaft and driven thereby in rotary-oscillatory motion in a vertical plane. A slide is positioned between the crown and bed, and a plurality of parallel guideposts are rigidly connected to either the crown or slide with the guideposts being held in parallelism solely by virtue of their connection to the crown or slide. A plurality of parallel guide bushings on the other of the crown and slide are aligned with the guideposts and the guideposts are received in the bushings and accurately guided thereby whereby the slide is guided for rectilinear motion in said vertial plane. The connection arm is rotatably connected to the slide assembly by a pivotal connection for converting the rotary-oscillatory motion of the connection arm into the rectilinear motion of the slide assembly. Bearings are provided on the crown for engaging the slide assembly at at least two bearing points in the vertical plane on directly opposite sides of the slide assembly, the bearing points lying along a line intersecting the axis of rotation of the pivotal connection as the slide assembly reciprocates whereby tilting of the slide in the direction of the vertical plane is resisted.

In the preferred embodiment of the invention, the parallel guideposts are rigidly connected to and depend from the crown and are held in parallelism solely by their connection to the crown. The slide assembly is reciprocably mounted on the guidepost, as by a plurality of bushings, and accurately guided thereby for rectilinear motion in the vertical plane.

It is an object of the present invention to provide a mechanical press wherein the slide is guided by a plurality of guidepost-bushing pairs or with either the guideposts or bushings being rigidly connected to the crown and relying solely on this connection to remain in parallelism.

It is a further object of the present invention to provide a mechanical press of the type described in the preceding paragraph wherein bearing forces are exerted on the connection between the connection arms and slide so as to resist tilting in the front-to-back direction about a horizontal plane. These bearing forces are exerted along lines which intersect the axis of rotation of the pivotal connections between the connection arms and slide assembly, such as the wrist pins in the preferred embodiment.

Yet another object of the present invention is to provide a press having dynamic balancing wherein the dynamic balancer weight is guided on a plurality of pins rigidly connected to the crown.

These and other objects of the present invention will be apparent from the detailed description considered together with the appropriate drawing figures.

DETAILED DESCRIPTION OF A PREFERRED EMBODIMENT

Figure 1:
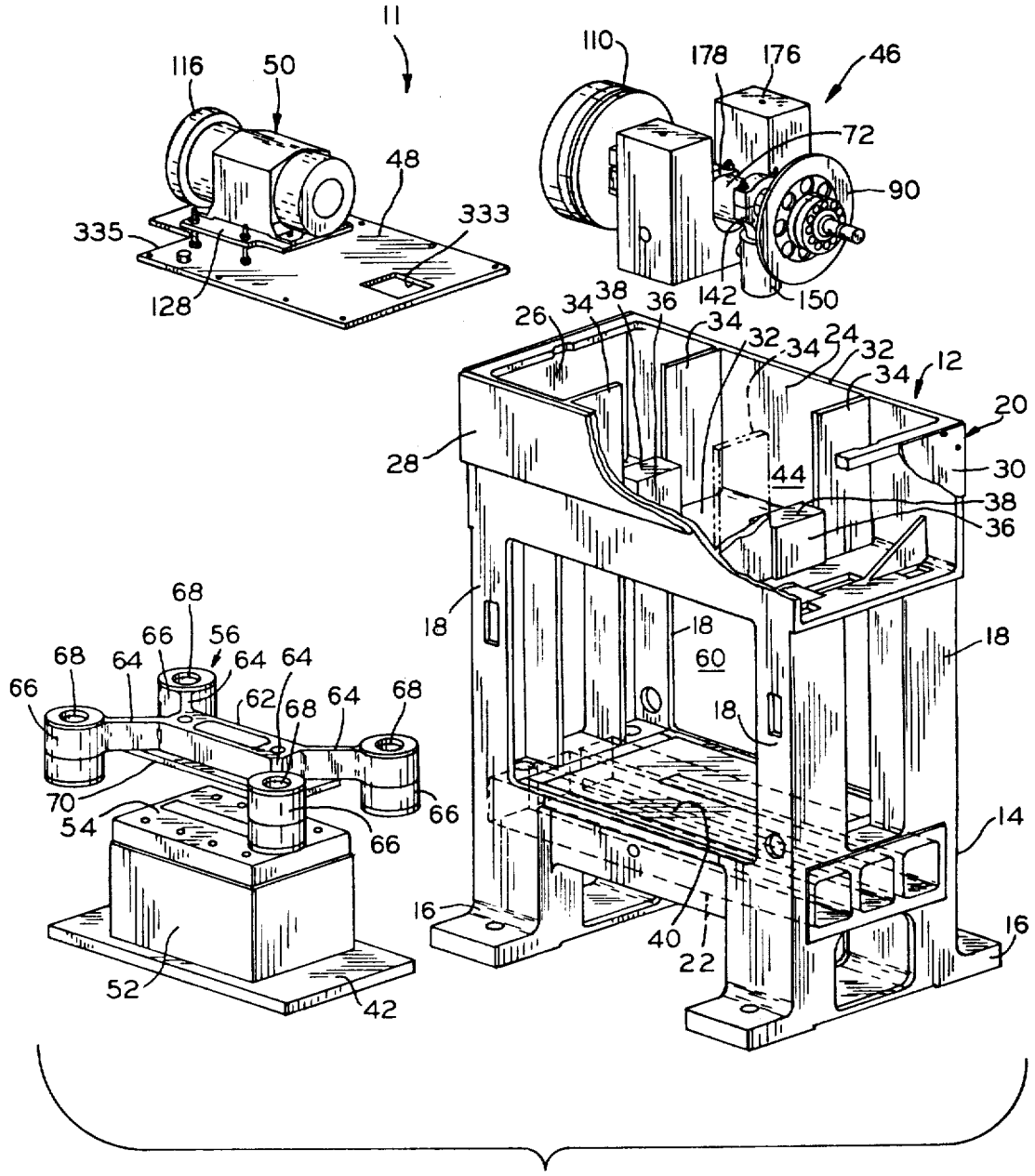
FIG. 1 is an exploded perspective view of the press according to the present invention.

FIG. 1 illustrates the press 11 of the present invention in exploded form, and it will be noted that the major subassemblies of the press are modular in nature. The press comprises a frame 12, which is a single casting and comprises a bed 14 supported on legs 16, four uprights 18 integral with bed 14 and extending upwardly therefrom, and a crown 20 integral with uprights 18. Bed 14 includes three horizontal chambers 22 extending laterally therein and being interconnected at their ends to form a single oil sump within bed 14. As will be described later, sump 22 receives the oil which has dripped through the thermal exchange devices on uprights 18 so that it can be pumped upwardly again to crown area 20.

Crown 20 comprises sides 24 and 28 and removable doors 26 and 30 and a bottom 32 integral with sides 24 and 28. It will be noted that the crown 20 terminate in an upper edge 32 so that the top of crown 20 is open. Vertical web-like partition members 34 are also integral with sides 24,28 and bottom 32. A pair of bearing support pads 36 are integral with partition elements 34 and bottom 32 and each include a very accurately machined bearing block support surface 38 which is parallel with the surface 40 of bed 14 on which bolster plate 42 is mounted. The sides 24–30 and bottom 32 of crown 20 together define the crank chamber indicated as 44.

As will be described in greater detail at a later point, crown 20 is open in the upward direction so that the drive assembly 46 can be inserted vertically therein in a completely assembled form as a modular subassembly. After the drive assembly 46 is in place, coverplate 48 is bolted to crown 20 and motor assembly 50 is mounted thereon.

Bolster plate 42 to which bolster 52 is mounted is bolted to the upper surface 40 of bed 14, in a manner to ensure that the upper surface 54 of bolster 52 is absolutely parallel to the bearing block support surfaces 38 of bearing support pads 36 in crown 20. In a manner well known in the art, bolster 54 is adapted to have the lower half of the die set (not shown) mounted thereto.

Figure 6:
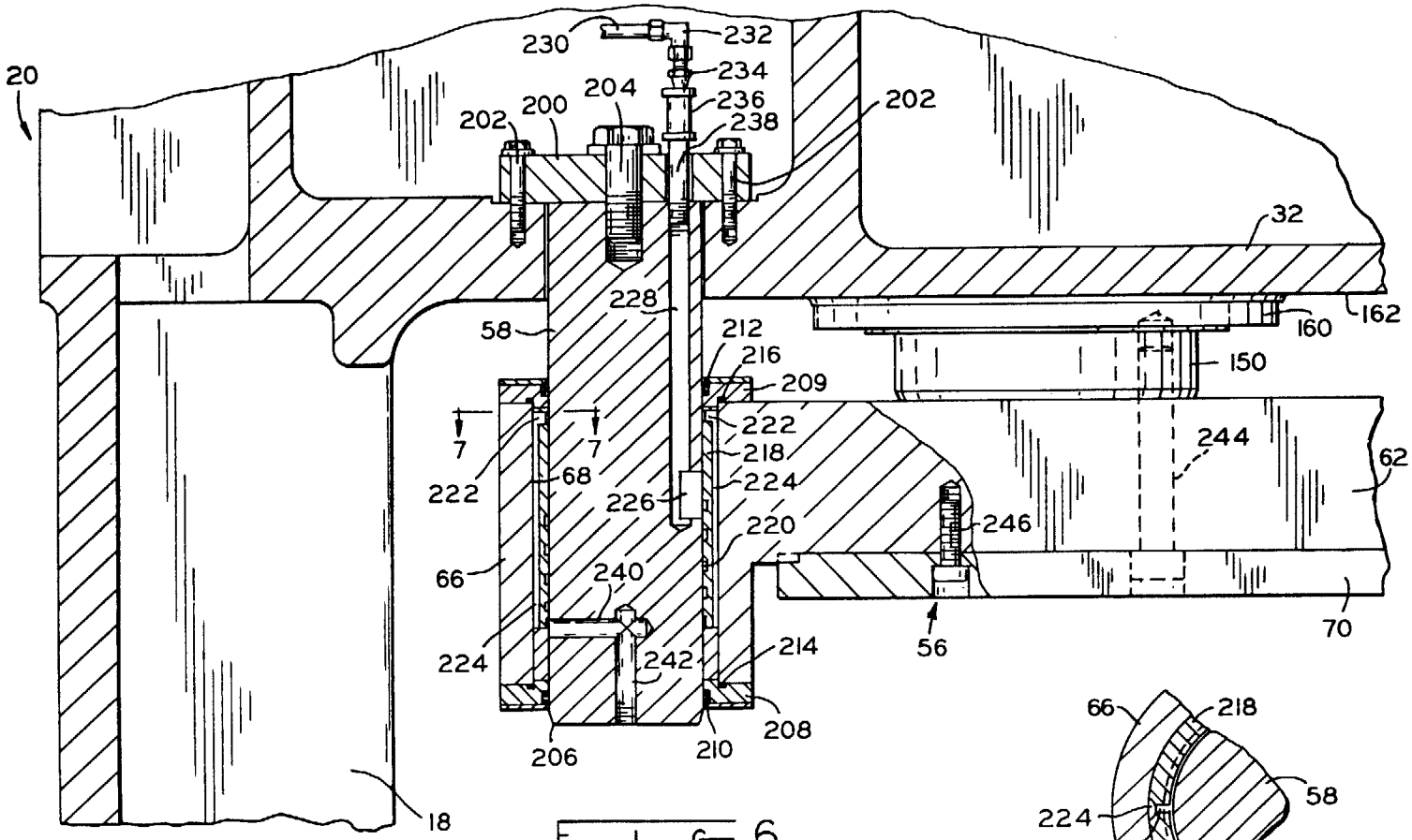
FIG. 6 is a fragmentary sectional view of the slide and guidepost assembly.

Slide 56 is mounted on four guideposts 58 (FIG. 6) that are rigidly connected to and depend downwardly from crown 20 and is adapted to slide over the guideposts in a rectilinear manner within the opening 60 between crown 20 and bolster 54 and between the left and right pairs of uprights 18. Slide 56 comprises a center portion 62, four web members 64 extending outwardly therefrom in a horizontal direction, and four bushing assemblies 66 integrally connected to web members 64. Web members 64 are relatively thin in relation to their height so that the mass of the slide 56 can be maintained as low as possible yet there is sufficient stiffness and rigidity to resist deformation in the vertical direction. By way of example, web members 64 could have a thickness of 2.5 inches and a height of 5.5 inches. The bushing assembly 66 each comprises an opening 68 extending completely therethrough and adapted to receive and be guided by guideposts 58 (FIG. 6). A slide plate 70 is removably mounted to the lower surface of slide 56 and includes a drill hole pattern suitable for the particular die set used.

Referring now to FIGS. 2 through 5, the drive assembly 46 will be described in greater detail. Drive assembly 46 comprises a crankshaft 72 having three eccentrics 74, 76 and 78 thereon, crankshaft 72 being rotatably supported within main bearing blocks 80, which are supported on the upper support surfaces 38 of pads 36. Bearing blocks 80 are of the split type and each comprise a cap 82 connected to the lower portion thereof and to pads 36 by bolts 84. Main bearings 86 are mounted within bearing blocks 80 and the portions 88 of crankshaft 72 are journaled therein.

Figure 2:
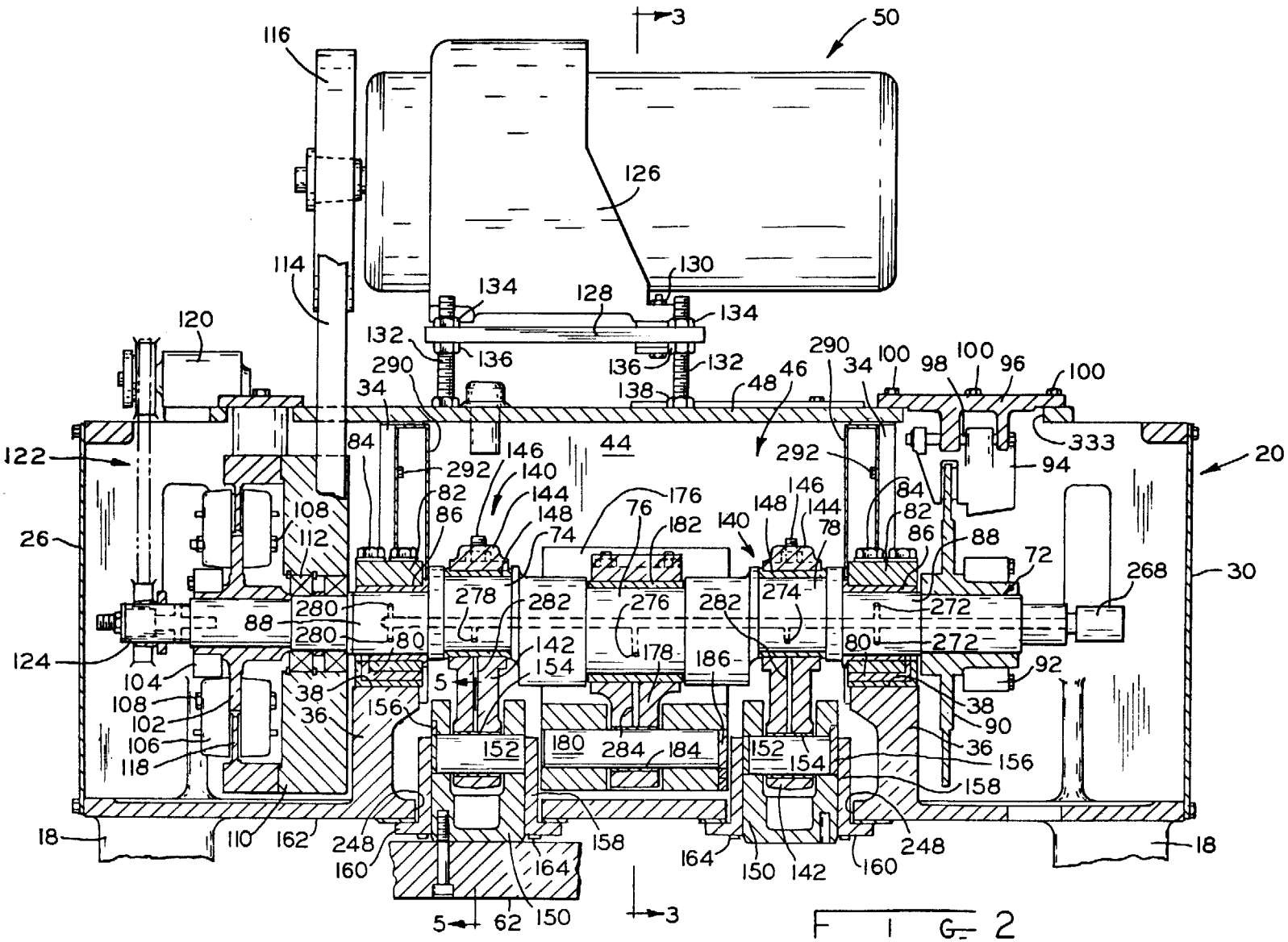
FIG. 2 is a sectional view of the crown and drive assembly of the press.

A brake disc 90 is frictionally mounted to the rightmost end of crankshaft 72 as viewed in FIG. 2 by means of Ringfeder 92, and a brake caliper 94 is mounted to bracket 96 by stud and nut assembly 98 such that it engages brake disc 90 when energized. Bracket 96 is connected to cover plate 48 by screws 100.

Still referring to FIG. 2, a clutch hub 102 is frictionally clamped to crankshaft 72 by Ringfeder 104, and has a plurality of calipers 106 rigidly connected thereto by bolts 108. A flywheel 110 is rotatably supported on crankshaft 72 by bearings 112 and is driven by a flat belt 114. Belt 114 is disposed around motor pulley 116, which is driven by motor 50. When motor 50 is energized, flywheel 110 constantly rotates but does not drive crankshaft 72 until clutch calipers 106 are energized. At that time, the friction disc 118 of flywheel 110 is gripped and the rotating motion of flywheel 110 is transmitted to crankshaft 72 through calipers 106 and hub 102. Solid-state limit switch 120 is driven by a pulley and belt arrangement 122 from the end of crankshaft 72 and controls various press functions in a manner well known in the art. Rotary oil distributor 124 supplies oil to the left end of crankshaft 72.

Motor 50 is connected to cover plate 48 by means of bracket 126 connected to mounting plate 128 by bolts 130, plate 128 being connected to cover plate 48 by studs 132 and lock nuts 134, 136, and 138. The tension on belt 114 can be adjusted by repositioning plate 128 on studs 132 by readjusting the positions of lock nuts 134 and 136 along studs 132.

In the preferred embodiment, the drive assembly 46 comprises two connection assemblies 140 each comprising a connection arm 142 having a connection cap 144 connected thereby by stud and nut assembly 146. Bearings 148 are disposed between the respective connection arms 142 and the eccentrics 74 and 78 of crankshaft 72. Connection assemblies 140 are similar to those disclosed in U.S. Pat. No. 3,858,432, which is owned by the assignee of the present application, and comprise pistons 150 rotatably connected to connection arms 142 by wrist pins 152 and bearings 154. Keys 156 lock wrist pins 152 to pistons 150.

Figure 4:
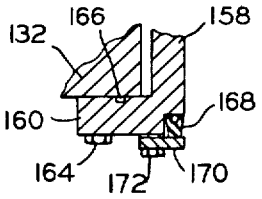
FIG. 4 is an enlarged fragmentary view of the sealing arrangement for the pistons and cylinders.

Pistons 150 are slidably received within cylinders 158, the latter including flanges 160 connected to the lower surface 162 of crown 20 by screws 164 and sealed thereagainst by O-rings 166 (FIG. 4). Seals 168 provide a sliding seal between pistons 150 and their respective cylinders 158 and are held in place by seal retainers 170 and screws 172 (FIG. 4).

The press 11 is dynamically balanced to counteract the movement of connection assemblies 140 and slide 62 by means of a balancer weight 176 connected to the eccentric 76 of crankshaft 72 by counterbalance connection arm 178 and wrist pin 180. Bearings 182 and 184 have eccentric 76 and wrist pin 180, respectively, journaled therein, and key 186 locks wrist pin 180 to weight 176.

Figure 3:
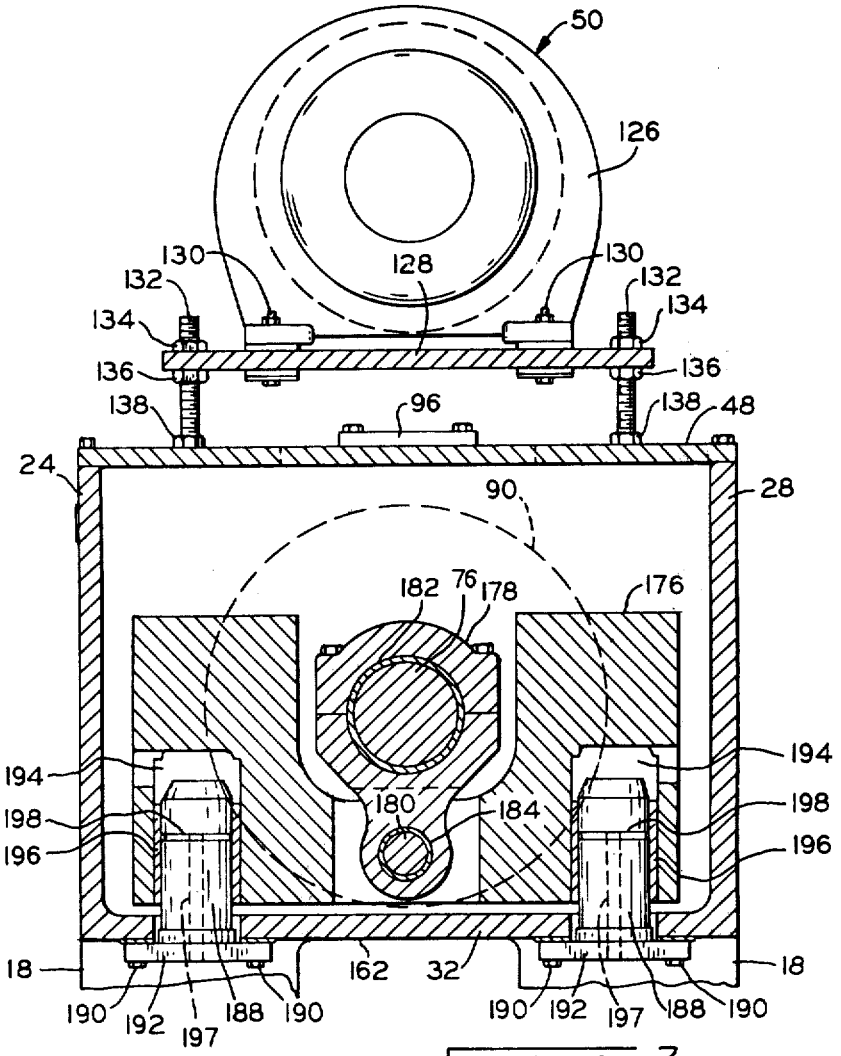
FIG. 3 is a sectional view taken along line 3—3 of FIG. 2 and viewed in the direction of the arrows.

Referring to FIG. 3, it will be seen that weight 176 is guided by means of a pair of guide pins 188 connected to the lower surface 162 of crown bottom 32 by screws 190 extending through flange portions 192. Guide pins 188 are received within openings 194 and guided by bearings 196. An axial passageway 197 conducts lubricating oil to groove 198 in order to lubricate the interface between pins 188 and their respective bearings 196. It will be seen that the position of eccentric 76 relative to eccentrics 74 and 78 on crankshaft 72 is 180° out of phase so that weight 176 moves rectilinearly in the opposite direction as pistons 150 and slide 62 in order to dynamically balance the press. Pins 188 are parallel to guideposts 58 so that slide 62 and weight 176 move in opposite directions vertically.

Figure 7:
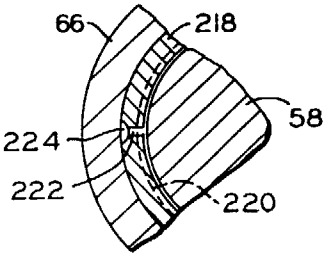
FIG. 7 is a sectional view taken along line 7—7 of FIG. 6 and viewed in the direction of the arrows.

Referring now to FIGS. 6 and 7, the guiding of slide 62 will be described. Four guideposts 58 are rigidly connected to the bottom 32 of crown 20 by means of flanges 200, with screws 202 connecting flanges 200 to crown 20 and screws 204 connecting guideposts 58 to flanges 200. There are four such guideposts connected to crown 20 in a symmetrical pattern in alignment with the openings 68 in bushing portions 66 of slide 56, and it will be noted that, unlike prior mechanical presses, guideposts 58 have distal ends 206 which terminate short of bed 14. In prior art mechanical presses, it is more common to utilize tie rods extending from the crown to the bed on which the slide is guided, or the slide is guided by gib surfaces fastened to the corners of the uprights. As discussed earlier, the relatively short extension of guideposts 58 and the fact that they are connected only to the crown 20 is advantageous in ensuring that they are parallel to each other, a condition which is imperative if slide 56 is to move perpendicularly relative to bolster 52.

A pair of seal plates 208 and 209 are connected to the upper and lower ends of bushing portions 66 and contain seals 210 and 212 and O-rings 214 and 216, respectively. Bearings 218 having a spiral groove 220 therein are received within openings 68 in bushing portions 66 of slide 56 and serve to establish oil films between them and the outer surfaces of guideposts 58 as slide 56 reciprocates. A pair of radial passages 222 are connected with a pair of axial passages 224, and oil is supplied to spiral groove 220 through slot 226 from axial passage 228. Oil is supplied to passage 228 from hose 230 through fittings 232, 234, 236 and nipple 238, and is conducted away from guideposts 58 through drains 240 and 242.

Slide 62 is connected to the protruding ends of pistons 150 by screws 244 extending through the central portion 62 of slide 56, and slide plate 70 is connected to the slide center portion 62 by screws 246. As shown in FIG. 2, pistons 158 extend through openings 248 in the bottom 32 of crown 20.

As crankshaft 72 rotates, connection arms 142 reciprocate pistons 150 within cylinders 158 along axes parallel to the axes of guideposts 58. Although guideposts 58 guide slide 56 with very close tolerances, a front-to-back tilting problem has been observed in connection with slide 56 as it is reciprocated. As the eccentrics 74 and 78 of crankshaft 72 move beyond their top dead center positions, they transmit to pistons 150 not only a component of force in the vertical direction, but also a horizontal component which, due to the rigid connection between pistons 150 and slide 56, tends to cause slide 56 to tilt about a horizontal axis parallel to the axis of crankshaft 72. Not only does this tilting movement of slide 56 result in accelerated wear of the guide bearing surfaces, but can result in unsatisfactory performance of the press in precision forming and stamping operations.

Figure 5:
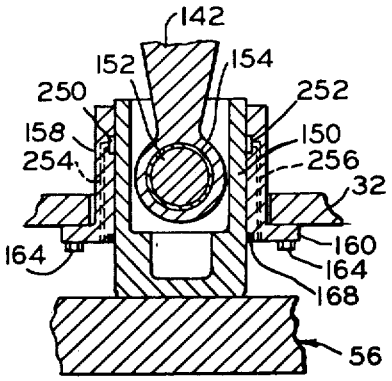
FIG. 5 is a sectional view taken along line 5—5 of FIG. 2 and viewed in the direction of the arrows.

In order to counteract this tilting force precisely at the point that it is exerted on pistons 150, a pair of hydrostatic bearings 250 and 252 are provided in cylinders 158 at positions directly opposite each other in a front-to-back direction intersecting the axis of pistons 150 and lying along lines which are intersected by the respective wrist pins 152 as pistons 150 are reciprocated. This relationship is illustrated in FIG. 5 wherein the slide is shown in its bottom dead center position. Fluid is supplied to hydrostatic bearings pockets 250 and 252 through passages 254 and 256, respectively. The pressurized hydraulic fluid exerted at the four points shown resist the tendency of pistons 150 to tilt in the front-to-back direction, and because the hydrostatic forces applied in the area of the wrist pins 152, the maximum resistive effect of the forces is realized.

Figure 8:
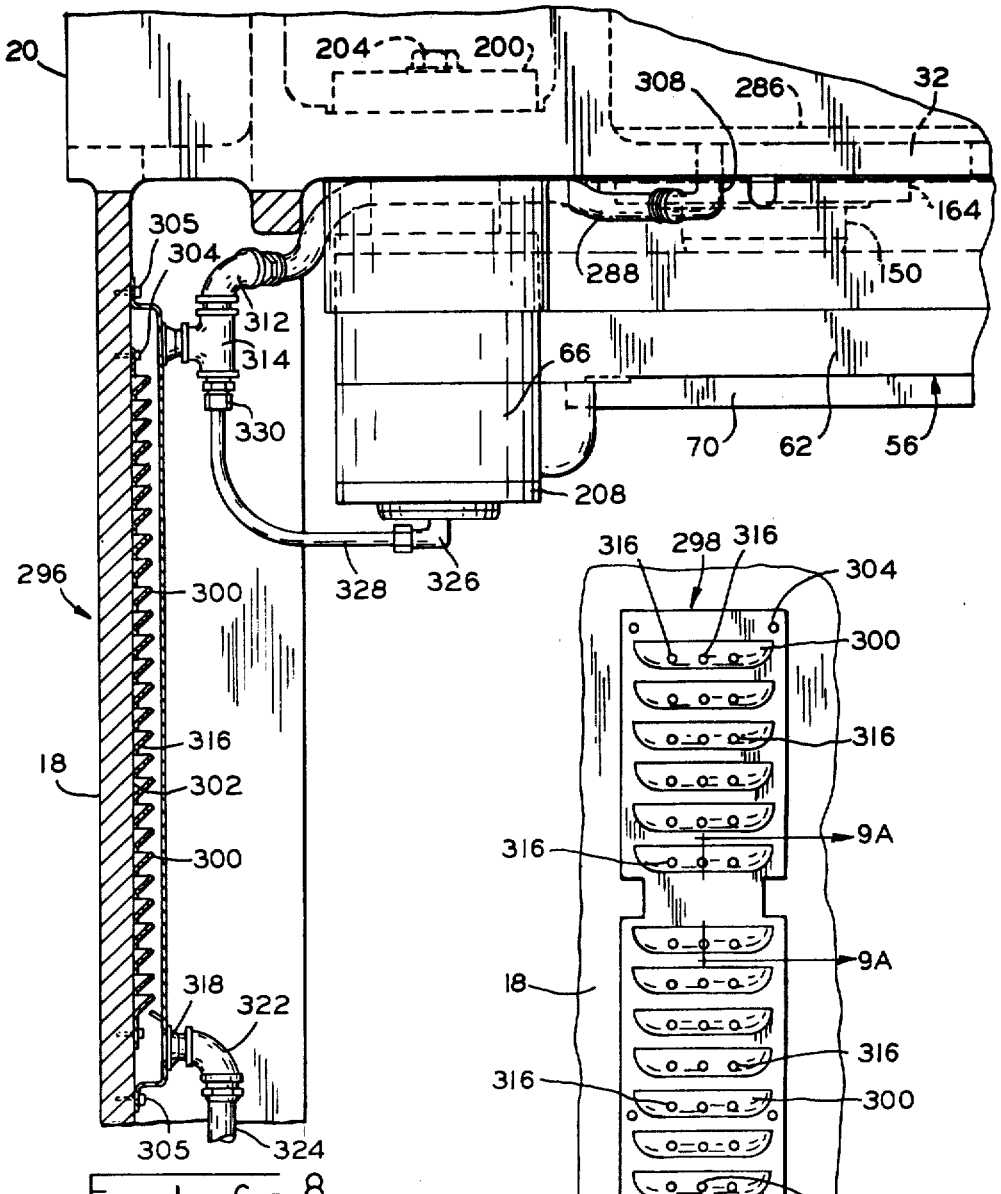
FIG. 8 is a sectional view of one of the thermal exchange devices.
Figure 9A:
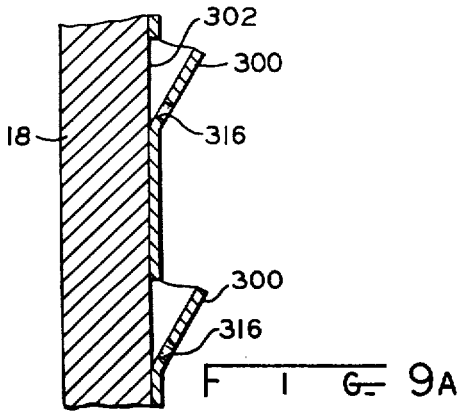
FIG. 9A is a sectional view of FIG. 9 taken along line 9A—9A.
Figure 9:
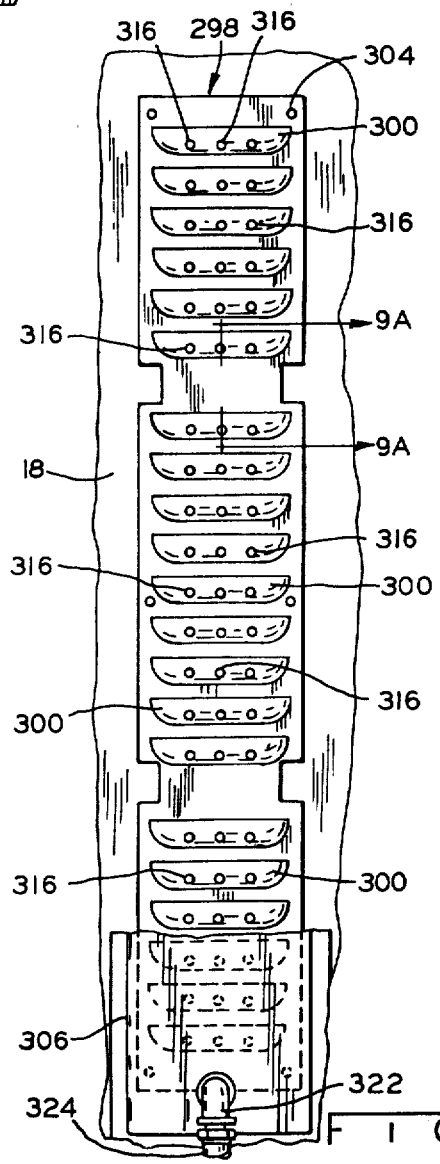
FIG. 9 is a front elevational view of the baffle plate.
Figure 10:
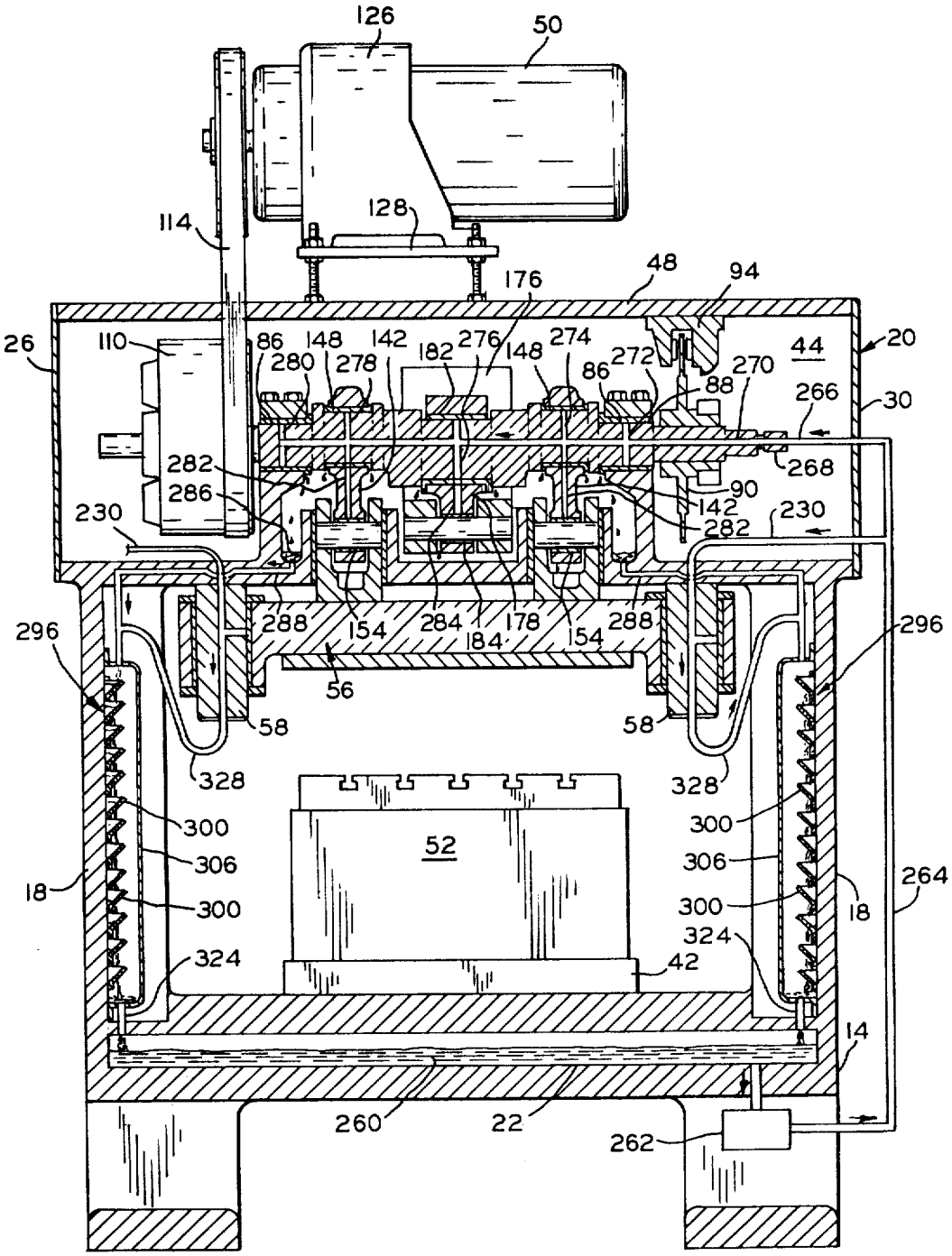
FIG. 10 is a diagrammatic view of the press showing the oil recirculation system.

With reference now to FIGS. 2, 6, 8, 9 and 10, the oil distribution and thermal stability system of the press will be described. As shown in FIG. 10, the lubricating oil 260 collects in sump 22 in bed 14 and is pumped by pump 262 upwardly through fluid line 264 to crown 20. Fluid line 266 connects to rotary oil distributor 268 that has an outlet connected to an axial passageway 270 in crankshaft 72. The oil flows from axial passageway 270 to bearing 86 through radial passages 272 in crankshaft 72, to bearing 148 through axial passages 274, to bearing 182 through axial passages 276, to bearing 148 through axial passages 278, and to bearing 86 through axial passages 280. Oil is supplied to wrist pin bearings 154 and 184 through passages 282 in connections 142 and passage 284 in dynamic balancer connection 178. The oil, which picks up heat from the drive assembly drains downwardly and is collected in a very shallow sump 286 within crown 20 and is drained therefrom through hoses 288. As shown in FIG. 2, a pair of sheet metal oil guards 290 are connected to partition members 34 and sealed thereagainst by seals 292. Guards 290 serve to seal the central portion of crank chamber 44 and permit all of the oil to be collected in its sump 286.

In order to compensate for the thermal growth of connections 142 due to the frictional heat generated as press 11 operates, heat is imparted to uprights 18 by means of circulating the oil from crown 20 through four thermal exchange devices 296 mounted on each of the uprights 18. In order that the uprights 18 elongate at the same rate as the connection assemblies 140 so that a constant shutheight is maintained, it is necessary that the following relationship be satisfied:

$$L_c dT_c a_c = L_u dT_u a_u$$

wherein $L_c$ is the length of the connections 142, $dT_c$ is the change in temperature of the connections 142, $L_u$ is the length of the uprights 18, $dT_u$ is the temperature change of the uprights, and $a_c$, $a_u$ are the coefficients of thermal expansion. What must be done is to impart the proper amount of heat per unit time to uprights 18 so that their change in temperature per unit time is proper to balance the equation given the change in temperature of the connections 142.

The thermal exchange device for accomplishing this according to the preferred embodiment of the invention is shown in detail on FIGS. 8 and 9 and comprises a stamped baffle plate 298 made of a material which may be a good thermal conductor, such as aluminum, or even a poor thermal conductor, such as molded plastic. Baffle plate 298 has a plurality of baffles 300 formed therein each adapted to hold a small pool of the hot oil drained from crown 20. Baffle plate 298 is mounted flush against the inner surface 302 of the respective upright 18 so that the individual baffles 300 cause the pools of oil to be held against the surface 302 of the upright 18. Baffle plates 298 are mounted to uprights 18 by screws 304. Also mounted to uprights 18 by screws 305 are four cover plates 306. Oil from sump 286 in crown 20 is conducted to the chambers formed between cover plates 306 and the inner surfaces 302 of the respective uprights by fitting 308, hose 288, fitting 312 and tee 314. Most of the oil is caught by the uppermost baffle 300 and held momentarily in contact with the inner surface 302 of respective upright 18. A plurality of holes 316 are formed in baffles 300 and cause the oil to drip from one baffle to the next so that the oil cascades down the baffles 300 of baffleplate 298 until it reaches outlet fitting 318. By means of this device, the hot oil from crown 20 is formed into a plurality of vertically spaced pools and held momentarily in contact with the upright so that a portion of its heat, which is the waste heat generated by friction in the crown 20, is imparted to the upright. The amount of heat which is transferred can be readily adjusted by varying the size of openings 316, by changing the spacing of baffles 300, by changing the size of baffles 300, and other possible alternatives. When the press is manufactured, the baffle plates 298 will be fine tuned so that the proper heat transfer occurs.

After the oil has drained through the heat transfer devices 296 and the uprights 18, it is conducted by fitting 322 and hose 324 to the sump 22 within bed 14.

Lubricating oil is pumped to guideposts 58 through hoses 230, fittings 232, 234, 236 and nipples 238 (FIG. 6), and the return oil is conducted to fitting 314 (FIG. 8) through fitting 326, hose 328 and fitting 330. Once the oil has reached sump 22, it is again circulated to crown 20 by pump 262 and hose 264. Thus, the oil is continuously recirculated to the crown wherein it picks up waste heat generated by the frictional forces in the drive assembly, waste heat generated by the frictional forces in the drive assembly, drains through the thermal transfer devices 296 on the uprights 18 whereupon the proper amount of heat is transferred to the uprights 18 so that they will thermally expand at the same rate as connections 142, and is collected in the sump 22 and bed 14 for recirculation to crown 20. The advantage to this type of thermal stabilization system over the prior art techniques of utilizing electric heaters is that there is a direct relationship between the temperature of the oil and the temperature of the connections, and by using this same oil to heat the uprights, the system can be fine tuned so that thermal expansion of the uprights 18 and connections 142 occurs at the same rate.

Figure 11:
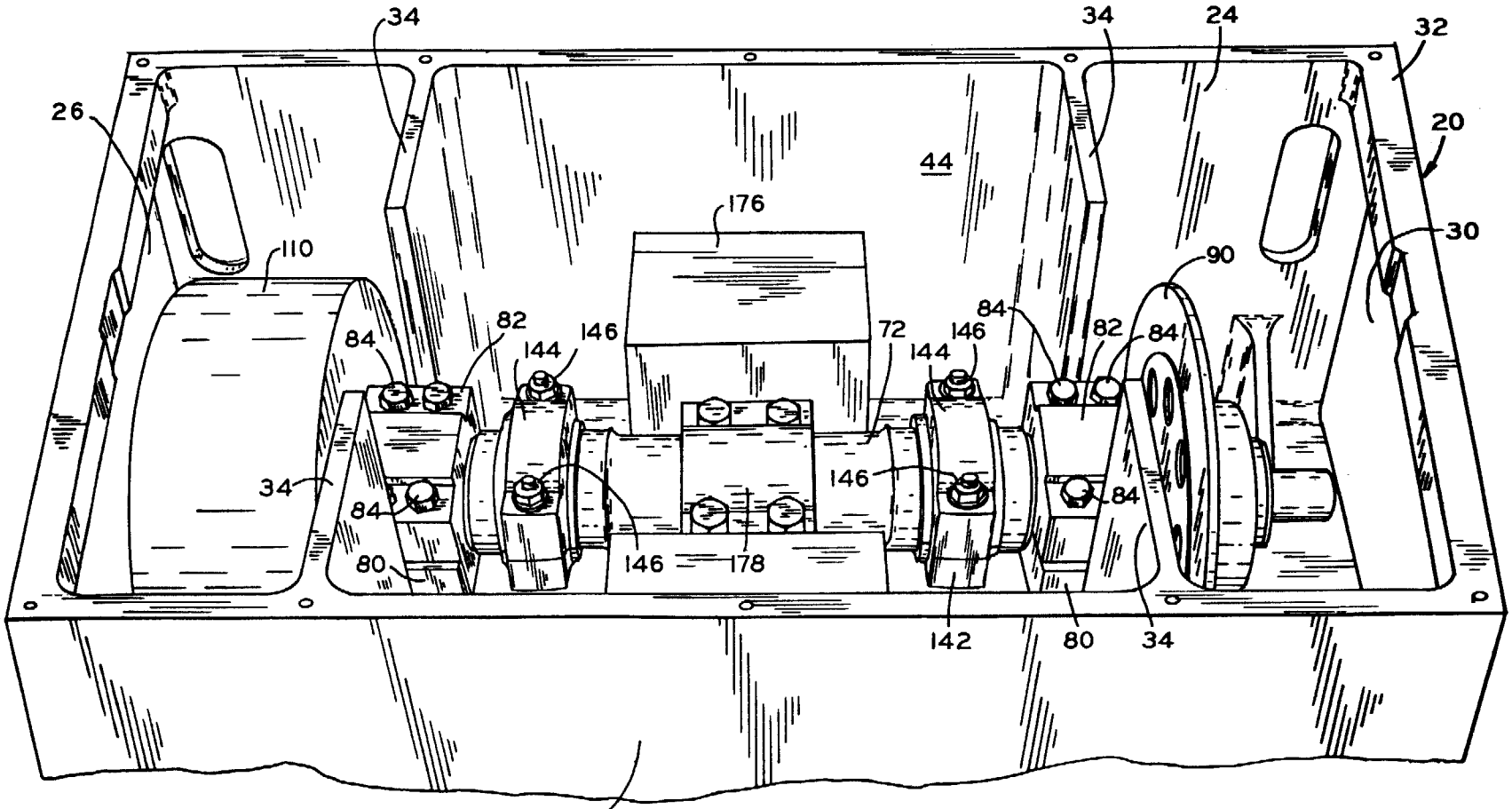
FIG. 11 is a top perspective view of the crown area of the press.

As alluded to earlier, press 11 is modular in nature and the major subassemblies thereof can be installed in preassembled form. This is particularly advantageous in connection with the drive assembly 46 comprising crankshaft 72 to which is attached the connections 142 and 178, pistons 150, weight 176, brake disc assembly 90, flywheel 110 and clutch caliper assembly 106, 102. Crown 20, which is integral with uprights 18, includes a drive assembly chamber 44 defined by sides 24, 26, 28 and 30 and bottom 32, and is open in the upward direction. When the entire drive assembly has been preassembled, it can be lowered into crank chamber 44 as shown in FIG. 1 to the position shown in FIG. 11. The lower portions of the main bearing blocks are first emplaced on the upper surfaces 38 of pads 36, the drive assembly is then lowered into place on the lower halves 80 of the bearing blocks, the top halves are emplaced and then fastened to the lower halves and to pads 36 by bolts 84.

After the drive assembly is in place, the cover plate 48 is attached to crown 20 and brake caliper and bracket assembly 94, 96, 98 is inserted through opening 333 to the position illustrated in FIG. 2, whereupon it is secured in place by screws 100. Motor assembly 50 is then mounted to cover plate 48. Limit switch 120 is driven by the pulley on the end of crankshaft 72. and the belt 122 extends into chamber 44.

As drive assembly 46 is lowered into crown chamber 44, pistons 150 are guided through openings 248 (FIG. 2) in crown 20 so that they protrude beyond the lower surface 162 of crown 20. Cylinders 158 can either be installed prior to the installation of drive assembly 46 or afterwards by pushing them upwardly through openings 248 and then holding them in place. Next, slide 56 is mounted to pistons 150 by screws which extend through the central portion 62 thereof. As the drive assembly 46 is lowered into chamber 44, the main bearing block portions 80, 82 pass between partition webs 34 (FIG. 1). The drive belt 114 from motor 50 to flywheel 110 extends through a notch 335 in top cover plate 48, which is shown in FIG. 1.

Side members 26 and 30 of crown 20 are removable so that the hydraulic connections and other adjustments can be made in connection with fluid unions 124 and 268. Bolster 52 and bolster plate 42 are mounted to bed 14 in the customary manner.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A mechanical press comprising: a bed, a crown, a frame interconnecting the bed and crown, crankshaft means rotatably mounted in the crown, at least one connection arm connected to an eccentric portion of said crankshaft means and driven by said crankshaft means in rotary-oscillatory motion in a vertical plane, a plurality of parallel guideposts rigidly connected to and depending from said crown, said guideposts being held in parallelism solely by their connection to said crown, a slide assembly reciprocably mounted on said guideposts and accurately guided thereby for rectilinear motion in said vertical plane, said connection arm being rotatably connected to said slide assembly by a pivotal connection means for converting the rotary-oscillatory motion of said connection arm into the rectilinear motion of said slide assembly, and bearing means on said crown engaging said slide assembly at least two bearing points in said vertical plane on directly opposite sides of said slide assembly, said bearing points lying along a line intersecting the axis of rotation of said pivot connection means as said slide assembly reciprocates, whereby tilting of said slide in the direction of said vertical plane is resisted.

2. The press of claim 1 wherein said guideposts are cantilevered on said crown and have distal ends that are unsupported.

3. The press of claim 1 including hydrodynamic bearing means for establishing a film of lubricating fluid between said posts and slide.

4. The press of claim 1 wherein said slide assembly comprises a piston connected to said connection arm by said pivotal connection means, said piston is slidably received in a cylinder connected to said crown and protrudes through said cylinder beyond said crown, and said slide assembly includes a slide that is rigidly connected to said piston.

5. The press of claim 4 wherein said bearing means comprises two hydrostatic bearing pockets established between said piston and cylinder, said pockets being located in said vertical plane and on directly opposite sides of said slide along a line substantially intersecting the axis of said pivotal connection.

6. The press of claim 5 wherein said pivotal connection is a wrist pin extending through said piston and having its opposite ends received in said cylinder.

7. The press of claim 4 wherein said pivotal connection is a wrist pin extending through said piston and having its opposite ends received in said cylinder.

8. The press of claim 1 including a dynamic balancer in said crown comprising: a weight, a dynamic balancer connection arm rotatably connected to an eccentric on said crankshaft and connected to said weight through a pivot, and guide pin means in said crown for guiding said weight for vertical rectilinear motion along the same direction as said slide, said guide pin means comprising at least two pins rigidly connected to said crown and received within two openings in said weight, and further comprising close tolerance bearings between said pins and openings.

9. The press of claim 8 wherein said guide pin means comprises hydrodynamic bearing means for establishing an oil film between the guide pins and the weight.

10. The press of claim 8 wherein said guide pins project upwardly into the weight openings.

11. The press of claim 1 wherein there are at least four said guideposts.

12. The press of claim 11 wherein said slide comprises a center portion, four sleeve portions spaced outwardly from said center portion, and four web portions connecting said sleeve portions to said center portion, said web portions each having a height dimension extending in generally the same direction as the direction of reciprocation of the slide and a thickness dimension perpendicular thereto, said height dimension being at least two times as great as said thickness dimension.

13. A mechanical press comprising: a bed, a crown, a frame interconnecting the bed and crown, crankshaft means rotatably mounted in the crown, at least one connection arm connected to an eccentric portion of said crankshaft means and driven by said crankshaft means in rotary-oscillatory motion in a vertical plane, a slide positioned between said crown and bed, a plurality of parallel guideposts rigidly connected to one of said crown and slide, said guideposts being held in parallelism solely by virtue of their connection to said one of said crown and slide, a plurality of parallel guide bushings on the other of said crown and slide and aligned with said guideposts, said guideposts being received in said bushings and accurately guided thereby whereby said slide is guided for rectilinear motion in said vertical plane, said connection arm being rotatably connected to said slide assembly by a pivotal connection means for converting the rotary-oscillatory motion of said connection arm into a rectilinear motion of said slide assembly, and bearing means on said crown engaging said slide assembly at at least two bearing points in said vertical plane on directly opposite sides of said slide assembly, said bearing points lying along a line intersecting the axis of rotation of said pivotal connection means as said slide assembly reciprocates, whereby tilting of said slide in the direction of said vertical plane is resisted.

14. The press of claim 13 wherein said slide assembly comprises a piston connected to said connection arm by said pivotal connection means, said piston is slidably received in a cylinder connected to said crown and protrudes through said cylinder beyond said crown, and said slide assembly includes a slide that is rigidly connected to said piston.

15. The press of claim 14 wherein said bearing means comprises two hydrostatic bearing pockets established between said piston and cylinder, said pockets being positioned in said vertical plane and on directly opposite sides of said slide along a line intersecting the axis of said pivotal connection.

16. The press of claim 15 wherein said pivotal connection is a wrist pin extending through said piston and having its opposite ends received in said cylinder.

17. The press of claim 13 including a dynamic balancer in said crown comprising: a weight, a dynamic balancer connection arm rotatably connected to an eccentric on said crankshaft and connected to said weight through a pivot, and guide pin means in said crown for guiding said weight for vertical rectilinear motion along the same direction as said slide, said guide pin means comprising at least two pins rigidly connected to said crown and received within two openings in said weight, and further comprising close tolerance bearings between said pins and openings.

* * * * *